US006345668B1

(12) United States Patent
Reilly

(10) Patent No.: US 6,345,668 B1
(45) Date of Patent: Feb. 12, 2002

(54) TUBING HANGER HAVING AN INTEGRAL VALVE GATE

(75) Inventor: Gavin Reilly, South Lanarkshire (GB)

(73) Assignee: FMC Corporation, Chicago, IL (US)

( * ) Notice: Subject to any disclaimer, the term of this patent is extended or adjusted under 35 U.S.C. 154(b) by 0 days.

(21) Appl. No.: 09/501,812

(22) Filed: Feb. 10, 2000

(30) Foreign Application Priority Data

Feb. 11, 1999 (GB) ..... 9903129

(51) Int. Cl.[7] ..... E21B 33/02

(52) U.S. Cl. ..... 166/332.2; 166/208; 166/332.8; 251/298

(58) Field of Search ..... 166/332.2, 332.8, 166/208; 251/298

(56) References Cited

U.S. PATENT DOCUMENTS

| | | | | |
|---|---|---|---|---|
| 4,215,749 A | | 8/1980 | Dare et al. | 166/361 |
| 4,513,823 A | * | 4/1985 | Hynes et al. | 166/386 |
| 4,519,575 A | | 5/1985 | Akkerman et al. | 251/58 |
| 4,572,298 A | * | 2/1986 | Weston | 166/379 |
| 5,415,378 A | * | 5/1995 | Craven | 251/329 |
| 6,176,316 B1 | * | 1/2001 | Hart | 166/368 |

FOREIGN PATENT DOCUMENTS

| | | |
|---|---|---|
| EP | 0 624 711 B1 | 2/1998 |
| GB | 1 334 311 | 10/1973 |
| GB | 2 287 263 A | 9/1995 |
| GB | 2 291 085 A | 1/1996 |
| GB | 2 321 658 A | 8/1998 |

* cited by examiner

*Primary Examiner*—William Neuder
(74) *Attorney, Agent, or Firm*—Pauley Petersen Kinne & Erickson

(57) ABSTRACT

A tubing hanger having two actuators 34, 70 disposed at opposite ends of a valve gate 28, to provide pressure balancing. Each actuator has a piston 36 acted on by a hydraulic fluid supplied to sealed spaces 54, 60 through ports 62, 66, 76, 74. Ports 66, 74 may be linked to prevent the two pistons from being forced apart by line pressure leaking from the passage 12 into cavity 72. A single actuator may be used for low pressure applications. A bias spring 68 provides fail safe closure of the valve gate 28.

20 Claims, 4 Drawing Sheets

TUBING HANGER HAVING AN INTEGRAL VALVE GATE

FIELD OF THE INVENTION

This invention concerns the control of annulus fluid flows in subsea oil or gas wells, and gate valves for this and other uses.

BACKGROUND OF THE INVENTION

Tubing hangers for use with conventional (i.e. non-horizontal) subsea Christmas trees are known which have an annulus passage for providing fluid communication between the tubing annulus and the tree. Current methods of controlling annulus flow in this passage include:

(a) setting or removing wireline plugs in the passage;
(b) use of an annular sliding sleeve that is arranged to block or allow fluid access to the passage;
(c) a wireline actuated shuttle valve provided in the passage;
(d) an hydraulically actuated shuttle valve provided in the passage;
(e) hydraulically or electrically operated ball valves provided in the passage.

Methods (a) and (c) require wireline access to the passage. Due to reliability problems with the remote actuators concerned, it has been common to additionally provide secondary wireline actuation capability in at least method (d). Wireline valve actuation or plug is itself time consuming and unreliable, especially at increased water depths. Moreover, providing the required wireline access means that the tubing hanger annulus passage and the corresponding annulus conduit in the tree cannot be unduly convoluted or offset from the wellhead center line. These design constraints will generally enlarge the tubing hanger and tree needed for a given production bore diameter. As maximum tree weight is limited by the supply vessel crane capacity, providing tubing hanger annulus passage wireline accessibility will reduce the maximum possible production bore diameter.

An alternative approach to the control of tubing annulus fluid flows is to provide a flow loop bypassing the tubing hanger and containing suitable flow control valves. This method is used in horizontal trees as well as some conventional completion designs, for example some tubing head completions.

British Patent Reference GB 2287263 (FMC) concerns a tubing hanger having an annulus bore closeable by a rotatable disc disposed horizontally so as to intersect with the production bore.

European Patent Reference EP 0624711 (Cooper Cameron) discloses a tubing hanger having a central bore opened and closed by a gate valve. Opposed valve actuators are located on the outside of a wellhead into which the tubing hanger is run. Actuating stems extending from the actuators push the valve gate between the open and closed positions.

There is thus a need for a remotely operable, high integrity tubing annulus isolation seal system, capable of selectively sealing or providing fluid communication with the tubing annulus, preferably without the need for wirelines. It would be of further advantage if this isolation seal system could be applied to either conventional or horizontal trees, providing greater standardization design between tree types.

SUMMARY OF THE INVENTION

Accordingly the invention provides a tubing hanger having a flow passage for well fluids; a cavity contained within the tubing hanger and intersecting with the flow passage; a valve gate linearly movably received in the cavity and containing a through bore, and an actuator substantially wholly contained in the cavity arranged to move the valve gate between a position in which the through bore is aligned with the flow passage to permit fluid flow through the flow passage and through bore, and a position in which the through bore and flow passage are out of alignment so that the valve gate seals the flow passage.

Thus, the flow passage (preferably a tubing annulus passage) in the tubing hanger is effectively furnished with a gate valve, which is the preferred oil industry flow control valve, having a proven record of high sealing integrity and long term reliability. The valve gate also provides shearing capability for wirelines, coiled tubing or other objects that may be lowered through the flow passage. The tubing hanger may be for use in a conventional wellhead in conjunction with a conventional tree, or for use in a horizontal tree.

Preferably the actuator has a piston received within the cavity so as to define, in conjunction with the cavity, an enclosed space to which hydraulic fluid may be supplied to move the piston. Apart from any necessary hydraulic service line penetrations, the tubing hanger and its integral gate valve and valve actuator will thus be entirely independent of the wellhead housing; readily installable in or retrievable from the wellhead housing as a self-contained unit.

The actuator may comprise a plug which closes an outer end of the cavity. The piston may be coupled to the valve gate, for example by a pin and slot connection, allowing limited float in the valve gate in the direction of the tubing annulus passage axis. A pair of such pistons may be provided, opposed and substantially identical, with one at each end of the gate, to define a pressure balanced, double acting actuator system. One or both parts of the flow passage on either side of the valve gate may be provided with a seat pocket containing a floating valve seat for sealing co-operation with the adjacent face of the valve gate. The valve gate is preferably resiliently biased to provide fail safe closure.

Further preferred features are described below in connection with illustrative embodiments of the invention shown in the drawings.

DESCRIPTION OF THE PREFERRED EMBODIMENTS

Figure 1:
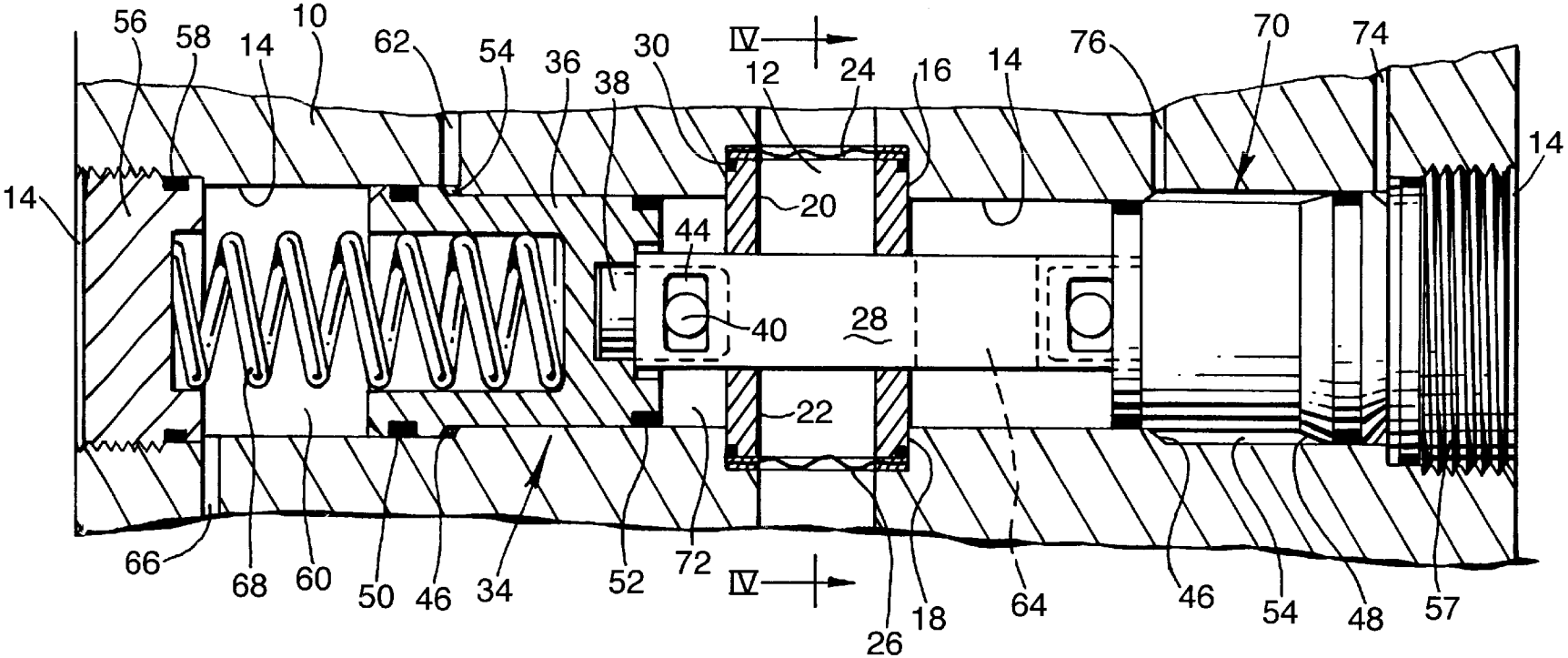
FIG. 1 is a diagrammatic part section through a tubing hanger according to the invention, showing a preferred valve gate and actuators.
Figure 2:
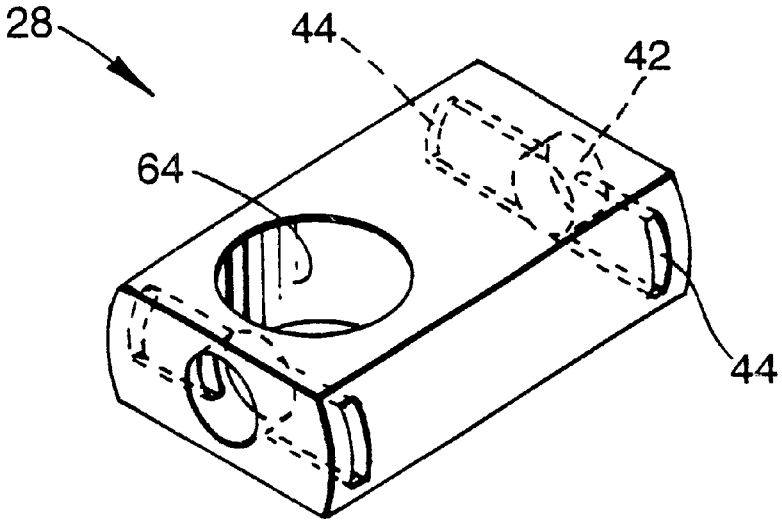
FIG. 2 is a perspective view of the valve gate shown in FIG. 1.
Figure 3:
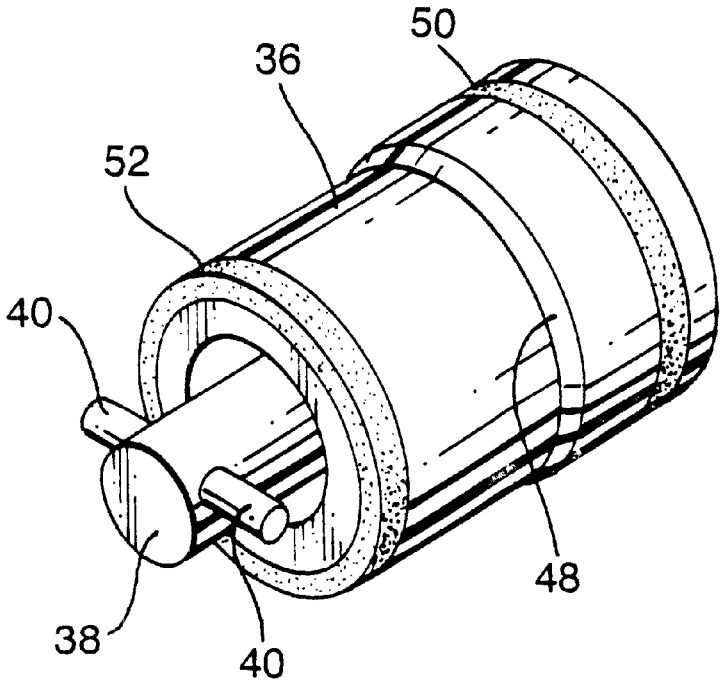
FIG. 3 is a perspective view of a piston shown in FIG. 1.
Figure 4:
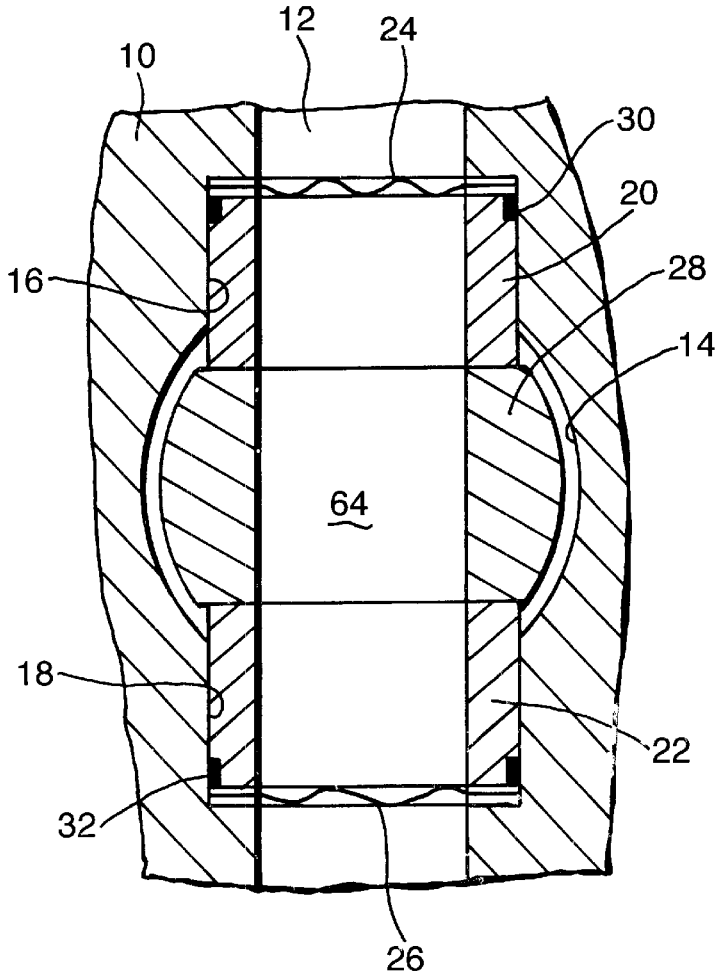
FIG. 4 is a sectional view of the seat/gate interface taken on line IV—IV in FIG. 1, but showing the valve gate in the open position.

As shown in FIGS. 1–4, a tubing hanger 10 includes a flow passage 12 (hereinafter "tubing annulus passage") in communication with a tubing annulus. A cavity 14 of slightly larger diameter than the tubing annulus passage 12 is bored transversely through the tubing hanger 10 so as to intersect the tubing annulus passage 12. Seat pockets 16, 18 are formed in the tubing annulus passage 12 adjacent to the cavity 14 for reception of floating valve seats 20, 22. Wave springs 24, 26 at the bottoms of the pockets 16, 18 bias the seats into sealing engagement with opposed faces of a valve gate 28 received in the cavity 14. Sealing rings 30, 32 seal the seats 20, 22 in the pockets 16, 18.

One end of the valve gate 28 is connected to an actuator 34 in the form of a piston 36 received in the cavity 14. A stub shaft 38 projects from the inner end of the piston 36 and is cross bored for reception of a connecting pin 40. The projecting end of the stub shaft 38 is loosely received in a socket 42 formed in the end of the gate 28, with the ends of the connecting pin 40 received in slots 44 cut transversely through the gate 28 so as to intersect the socket 42. In this way the gate 28 is attached to the piston 36. The slots 44 are elongated in the direction of the tubing annulus passage axis, to allow limited floating movement of the gate 28 in that direction, as required for proper sealing with the seats 20, 22.

The cavity 14 is stepped at 46 to define a relatively small diameter inner portion and a relatively larger diameter outer portion. The piston 36 is similarly stepped at 48 to define a relatively large diameter outer end and a relatively small diameter inner end. The larger end of the piston 36 is received in the larger diameter portion of the cavity 14 and sealed to it by a seal ring 50. The smaller inner end of the piston 36 is received in the smaller diameter portion of the cavity 14 and sealed to it by a seal ring 52. A sealingly enclosed annular space 54 is thereby defined between the steps 46 and 48.

The outer end of the cavity 14 behind the piston 36 is sealed by a screw threaded plug 56 and seal ring 58, so as to define a further enclosed space 60. Hydraulic fluid may be supplied to the space 54 through a port 62, so as to move the piston 36 and gate 28 to the left as viewed in FIG. 1. This brings a through bore 64 in the gate 28 into alignment with the tubing hanger annulus passage 12, opening it for fluid flow. Hydraulic fluid may also be supplied to the space 60 through a port 66, moving the piston 36 and gate 28 to the right, into the position shown in FIG. 1, where the tubing annulus passage is closed by a solid portion of the gate 28. A coil spring 68 is used to provide fail safe closure bias for the gate 28.

The foregoing arrangement is satisfactory for flow control with low tubing annulus pressures. However, higher tubing annulus line pressures supplied through the passage 12 will in the usual way leak past the upstream valve seat to act on the inner end of the piston 36 in the valve cavity 72, requiring higher hydraulic pressures at the port 66 in order to close the valve gate 28. Such high line pressures may completely overcome the force of the spring 68, so that the gate is no longer fail safe closing. To solve these problems, a pressure balanced system is preferably provided. As shown in FIG. 1, this is achieved by attaching a further actuator 70 to the valve gate 28, on the opposite side of the tubing annulus passage to the actuator 34. Actuators 34 and 70 and their attachments to the gate 28 are substantially identical, save that actuator 70 does not have a bias spring 68. In FIG. 1, actuator 34 and plug 56 are shown in section, whereas actuator 70 and plug 57 are shown in elevation. Equal and opposite line pressures act on the respective pistons of the actuators 34 and 70, thereby cancelling each other out. The valve gate 28 is opened by hydraulic fluid supplied to port 62 of actuator 34 and is closed by hydraulic fluid supplied to a corresponding port 76 of actuator 70.

To relieve tension imposed on the gate-to-piston connections (including the pin 40 and stub shaft 38 and the corresponding components of actuator 70) caused by the line pressure, the port 66 of actuator 34 may be directly connected to a corresponding port 74 of the actuator 70. The closed system thereby created is filled with substantially incompressible hydraulic fluid, preventing the pistons of the respective actuators from being forced apart by the line pressure. The stub shaft 38 and pin 40 of each actuator and the socket 42 and slots 44 in the valve gate 28 may therefore be omitted if desired. Then each piston simply pushes on the gate and is returned to a centralized position by the closed hydraulic circuit comprising the ports 66 and 74. Alternatively, if such tension relief for the valve gate/actuator connections is not required, the ports 62, 66, 74, 76 may be used in various readily apparent combinations to move the valve gate as desired. The four ports used in this way provide redundancy or backup capability (port 74 backing up port 62 and port 66 backing up port 76), further increasing the safety and reliability of the tubing annulus isolation system.

Figure 5:
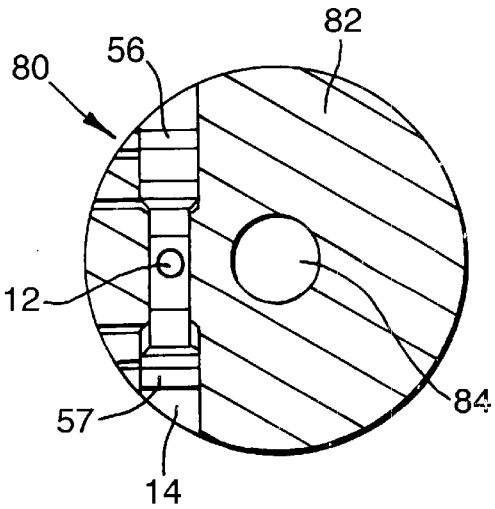
FIG. 5 is a diagrammatic, part sectional plan view of a tubing hanger embodying the invention, for use with a conventional tree.
Figure 6:
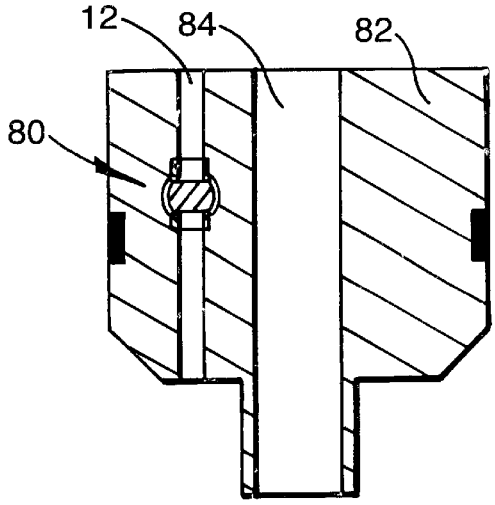
FIG. 6 is a diagrammatic, part sectional side view of the tubing hanger of FIG. 5.

Thus the invention may be used to provide a tubing hanger with one or more integral gate valves. FIGS. 5 and 6 show the positioning of such a valve 80 for tubing annulus isolation in a conventional (i.e. non-horizontal) tubing hanger 82 having a concentric production bore 84 and highly radially offset tubing annulus conduit 12.

Figure 7:
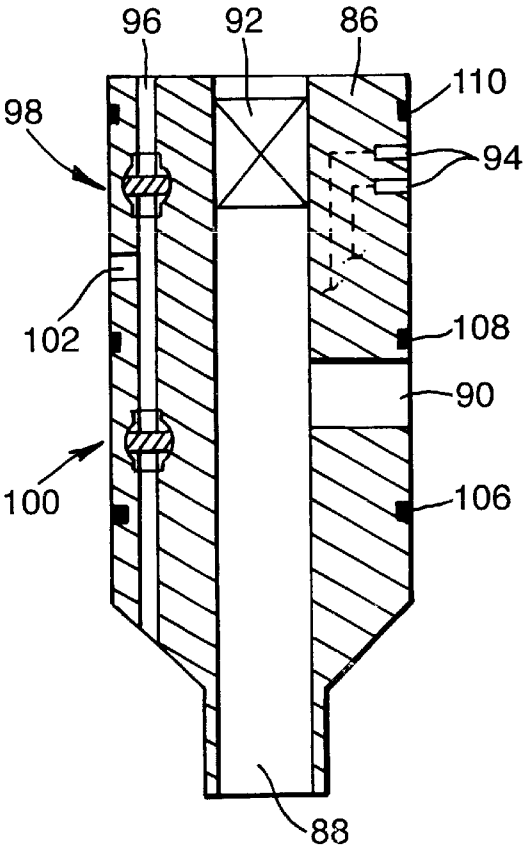
FIG. 7 is a diagrammatic, part sectional side view of a tubing hanger embodying the invention, for use with a horizontal tree.

FIG. 7 is a sectional view corresponding to FIG. 6, but shows a tubing hanger 86 for a horizontal tree, for example a high pressure horizontal tree. It includes a concentric, vertical production bore 88, closed above a horizontal production wing branch 90 by a plug 92. Penetrations 94 are provided for downhole service lines. In contrast to usual horizontal tree tubing hanger designs, a tubing annulus passage 96 is provided, extending vertically through the tubing hanger 86. A pair of gate valves 98, 100, formed substantially as described with reference to FIGS. 1–5, are provided in the passage 96, on either side of an annulus wing branch 102. These perform the functions of the annulus master valve and annulus access valve respectively, of known horizontal trees.

Figure 8:
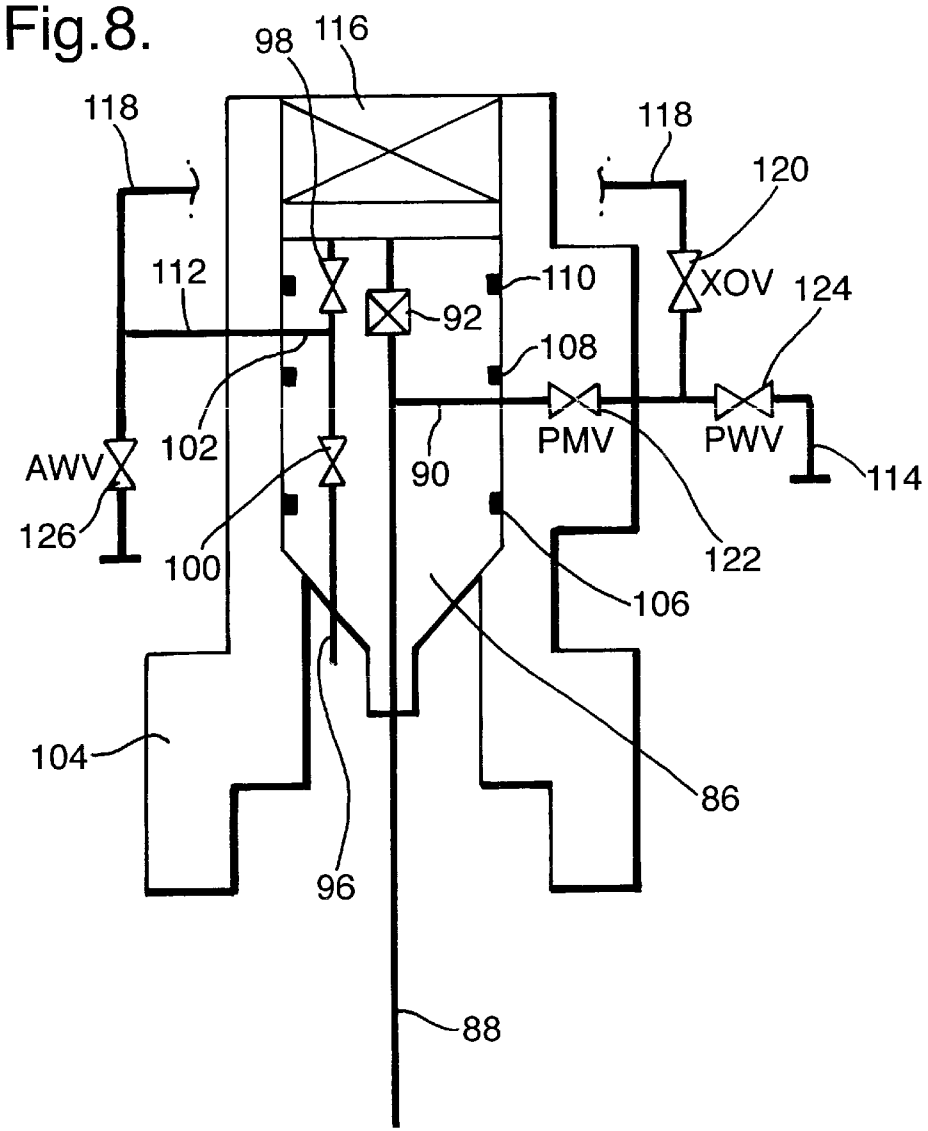
FIG. 8 is a fluid circuit diagram showing external valves for use with the tubing hanger of FIG. 7.

As shown in FIG. 8, the tubing hanger 86 is housed in a horizontal tree 104. Annular seals 106, 108, 110 isolate the production and annulus wing branches 90, 102 and connect them to corresponding annulus wing 112 and production wing 114 conduits terminating in the tree 104. The top of the tree above the tubing hanger 86 is sealed by an internal cap 116 in the usual way. The production wing conduit 114 contains a production master valve 122 and a production wing valve 124. One end of a crossover conduit 118 containing a crossover valve 120 is joined to the production wing conduit 114, between the valves 122, 124. The other end of the crossover conduit 118 is joined to the annulus wing conduit 112, inwardly of an annulus wing valve 126.

Although the production master valve 122 is shown to be internal to the tree block and the remaining valves 120, 124, 126 external to the tree block, any of these valves may be positioned either internally or externally as desired, as is well known. These valves are preferably remotely operable gate valves of the kind commonly used in subsea completions.

What is claimed is:

1. A tubing hanger comprising:

a flow passage for well fluids;

a cavity contained within the tubing hanger, the cavity intersecting with the flow passage;

a valve gate linearly movably received in the cavity, the valve gate containing a through bore; and an actuator substantially entirely contained in the cavity and arranged to move the valve gate between an open position to permit fluid flow through the flow passage and the through bore, and a closed position in which the valve gate seals the flow passage.

2. A tubing hanger in accordance with claim 1, comprising a plug which closes an outer end of the cavity.

3. A tubing hanger in accordance with claim 1, wherein the actuator comprises a piston received within the cavity so as to define, in conjunction with the cavity, an annular space to which a hydraulic fluid may be supplied to move the piston.

4. A tubing hanger in accordance with claim 1, wherein a first piston is attached to the valve gate on a first side of the flow passage and a second piston is attached to the valve gate on an opposite second side of the flow passage.

5. A tubing hanger in accordance with claim 4, wherein the first piston and the second piston are coupled to the valve gate by a connection allowing limited float in the valve gate in a direction of a flow passage axis.

6. A tubing hanger in accordance with claim 1, wherein a seat pocket has a floating valve seat for sealing engagement with a face of the valve gate.

7. A tubing hanger in accordance with claim 1, wherein the valve gate is resiliently biased to provide fail safe closure.

8. A tubing hanger in accordance with claim 1, comprising more than one integral valve gate.

9. A tubing hanger in accordance with claim 1, further comprising a coil spring to provide fail safe closure bias for the valve gate.

10. A tubing hanger in accordance with claim 3, wherein the piston is coupled to the valve gate by a connection allowing limited float of the valve gate in a direction of a flow passage axis.

11. A tubing hanger comprising:

a tubing annulus passage in communication with a tubing annulus;

a stepped cavity bored transversely through the tubing hanger, the stepped cavity intersecting the tubing annulus passage;

a valve gate received in the stepped cavity, the valve gate having a through bore and moveable between an open position whereby the through bore is aligned with the tubing annulus passage and a closed position whereby the tubing annulus passage is closed;

a first actuator received in the stepped cavity, the first actuator connected to the valve gate for moving the valve gate between the open position and the closed position;

a socket formed in an end portion of the valve gate; and a stub shaft formed in the first actuator, the stub shaft loosely positioned in the socket.

12. A tubing hanger in accordance with claim 11, wherein the first actuator comprises a stepped first piston received in the stepped cavity, defining a sealingly enclosed annular space.

13. A tubing hanger in accordance with claim 12, wherein a hydraulic fluid is supplied to the sealingly enclosed annular space through a port.

14. A tubing hanger in accordance with claim 11, wherein a plug is sealably connected to the tubing hanger at an outer end of the cavity behind the first actuator to define an enclosed space; and a port in the tubing hanger for supplying a hydraulic fluid to the enclosed space.

15. A tubing hanger in accordance with claim 11, further comprising a connecting pin to attach the first actuator to the valve gate.

16. A tubing hanger in accordance with claim 11, wherein the valve gate forms a slot for receiving a connecting pin to connect the first actuator to the valve gate, the slot allowing floating movement of the valve gate in a direction of a tubing annulus passage axis.

17. A tubing hanger in accordance with claim 11, further comprising a second actuator received in the stepped cavity, the second actuator connected to the valve gate on an opposite side of the tubing annulus passage as the first actuator.

18. A tubing hanger in accordance with claim 17, wherein a port of the second actuator is directly connected to a corresponding port of the first actuator.

19. A tubing hanger comprising:

a flow passage for well fluids;

a cavity contained within the tubing hanger, the cavity intersecting with the flow passage;

a valve gate linearly movably received in the cavity, the valve gate containing a through bore;

an actuator contained in the cavity and arranged to move the valve gate between an open position to permit fluid flow through the flow passage and the through bore, and a closed position in which the valve gate seals the flow passage, the actuator comprising a first piston attached to the valve gate on a first side of the flow passage; and a second piston attached to the valve gate on an opposite second side of the flow passage, wherein the first piston and the second piston are coupled to the valve gate by a connection allowing limited float in the valve gate in a direction of a flow passage axis.

20. A tubing hanger comprising:

a flow passage for well fluids;

a cavity contained within the tubing hanger, the cavity intersecting with the flow passage;

a valve gate linearly movably received in the cavity, the valve gate containing a through bore; and an actuator contained in the cavity and arranged to move the valve gate between an open position to permit fluid flow through the flow passage and the through bore, and a closed position in which the valve gate seals the flow passage, the actuator comprising a piston received within the cavity so as to define, in conjunction with the cavity, an annular space to which a hydraulic fluid may be supplied to move the piston, wherein the piston is coupled to the valve gate by a connection allowing limited float of the valve gate in a direction of a flow passage axis.

* * * * *